US009351564B1

(12) United States Patent
Romero

(10) Patent No.: US 9,351,564 B1
(45) **Date of Patent: *May 31, 2016**

(54) DOCUMENT HOLDER

(71) Applicant: Maria B Romero, Crystal Lake, IL (US)

(72) Inventor: Maria B Romero, Crystal Lake, IL (US)

( * ) Notice: Subject to any disclaimer, the term of this patent is extended or adjusted under 35 U.S.C. 154(b) by 12 days.

This patent is subject to a terminal disclaimer.

(21) Appl. No.: 14/213,556

(22) Filed: Mar. 14, 2014

Related U.S. Application Data

(63) Continuation-in-part of application No. 13/135,283, filed on Jun. 30, 2011, now Pat. No. 8,672,285.

(51) Int. Cl.
*B41J 11/02* (2006.01)
*A47B 21/04* (2006.01)

(52) U.S. Cl.
CPC ..... *A47B 21/045* (2013.01)

(58) Field of Classification Search
USPC ..... 248/441.1, 442.2, 447, 447.1, 452, 918; 361/679.25
See application file for complete search history.

(56) References Cited

U.S. PATENT DOCUMENTS

| | | | | | |
|---|---|---|---|---|---|
| 1,685,041 | A * | 9/1928 | Binkele | ..... | 248/442.2 |
| 4,619,429 | A * | 10/1986 | Mazza | ..... | 248/447.2 |
| 5,074,512 | A * | 12/1991 | Gianforcaro et al. | ..... | 248/442.2 |
| 5,078,358 | A * | 1/1992 | Egly et al. | ..... | 248/447.1 |
| 5,292,099 | A * | 3/1994 | Isham et al. | ..... | 248/442.2 |
| 5,383,642 | A * | 1/1995 | Strassberg | ..... | 248/442.2 |
| 5,385,327 | A * | 1/1995 | Hegarty et al. | ..... | 248/442.2 |
| 5,467,958 | A * | 11/1995 | Selvaggio | ..... | 248/449 |
| 5,499,793 | A * | 3/1996 | Salansky | ..... | 248/442.2 |
| 5,618,020 | A * | 4/1997 | Hegarty et al. | ..... | 248/442.2 |
| 5,651,524 | A * | 7/1997 | Calfee | ..... | 248/442.2 |
| 5,732,924 | A * | 3/1998 | Hegarty et al. | ..... | 248/442.2 |
| 5,769,378 | A * | 6/1998 | Correa | ..... | 248/442.2 |
| 5,901,937 | A * | 5/1999 | Compeau et al. | ..... | 248/442.2 |
| 5,975,478 | A * | 11/1999 | Marino | ..... | 248/442.2 |
| 6,024,337 | A * | 2/2000 | Correa | ..... | 248/442.2 |
| 6,173,936 | B1 * | 1/2001 | Hegarty | ..... | 248/442.2 |
| 6,290,200 | B1 * | 9/2001 | Ko | ..... | 248/442.2 |
| 7,611,117 | B1 * | 11/2009 | Lang, Jr. | ..... | 248/452 |
| 7,681,856 | B1 * | 3/2010 | Thomas et al. | ..... | 248/442.2 |
| 2002/0066846 | A1 * | 6/2002 | Giulie et al. | ..... | 248/442.2 |
| 2005/0001135 | A1 * | 1/2005 | Bauman et al. | ..... | 248/444.1 |

* cited by examiner

*Primary Examiner* — Bradley Duckworth
(74) *Attorney, Agent, or Firm* — Brie A. Crawford

(57) ABSTRACT

A document holder for a computer holds multiple documents at a single time and provides easy visual access for up to three documents concurrently. The document holder attaches to a computer and has a fully extended position during the time the document holder is in use. Also, the document holder has a stored position which allows it to be compactly stored on the computer when not in use. The stored position allows the document holder to remain attached to, but not interfere with, the use of the computer. The document holder has mount clamps which provide easy attachment and removal to and from the computer.

9 Claims, 14 Drawing Sheets

DOCUMENT HOLDER

CROSS REFERENCE TO RELATED APPLICATION AND INCORPORATION BY REFERENCE

This application is a continuation-in-part of and claims priority to the previously filed United States of America Utility Patent Application titled DOCUMENT HOLDER, with an application filing date of Jun. 30, 2011, in the United States Patent and Trademark Office, application Ser. No. 13/135,283 by the same inventive entity, the entirety of said application being incorporated herein by reference to provide continuity of disclosure. A Notice of Allowance was granted on application Ser. No. 13/135,283 on Oct. 18, 2013 and the Issue Fee was paid on Jan. 21, 2014. At the time of filing this continuation-in-part application, the Issue Notification states that application Ser. No. 13/135,283 will issue into U.S. Pat. No. 8,672,285 on Mar. 18, 2014.

This invention relates to a document holder and more particularly to a document holder which attaches to a desktop or laptop computer and provides easy visual access simultaneously to multiple documents.

BACKGROUND OF THE INVENTION

In today's world, computers are necessary, if not essential, for both business and home matters. Both laptop computers and desktop computers are used to conduct business, manage household affairs, complete educational assignments, and provide entertainment.

When using a laptop or desktop computer, it is many times necessary to have easy access to a variety of documents. The documents may be placed on the desk or table but this requires the user to look down to view the information on the documents. A document holder which can provide easier visual access to documents is a useful invention.

Also, many times it is necessary to access a number of documents while working on a desktop or laptop computer. If the documents are stacked in piles on a table or desk, it requires the user to stop working and move pages around to access multiple documents. This can be very time consuming and frustrating for the user. A document holder which can provide easy access to multiple documents without the need to stop work is a useful invention.

Moreover, when multiple documents are being utilized, organizing them in a usable fashion becomes a challenge. A user may have to search through a pile of papers to find the necessary document. This challenge can also be time consuming and frustrating for the user. A document holder which can organize large numbers of documents is a useful invention.

While the document holder must be able to present and organize a large amount of documents, it also must be compact and easily stored. The document holder cannot interfere with the use of the desktop or laptop computer when it is stored. A document holder which can be easily stored is a useful invention.

SUMMARY OF THE INVENTION

Among the many objectives of the present invention is the provision of a document holder which provides easy visual access to multiple documents at a time.

Yet another objective of the present invention is the provision of a document holder which does not require a user to look down or away from the computer to read the document.

A further objective of the present invention is the provision of a document holder which can organize a large number of documents at a time.

Moreover, another objective of the present invention is the provision of a document holder which securely holds the documents in place.

A still further objective of the present invention is the provision of a document holder which folds down into a compact storage position when not in use and does not interfere with the use of the computer.

Also, an objective of the present invention is the provision of a document holder which allows documents to be readily removed and reorganized.

Another objective of the present invention is the provision of a document holder which can be attached to a computer without the need for adhesives or glue.

Moreover, an objective of the present invention is the provision of a document holder which can be easily attached to and removed from a computer.

These and other objectives of the invention (which other objectives become clear by consideration of the specification, claims and drawings as a whole) are met by providing a document holder for a desktop or laptop computer which allows easy visual access to multiple documents, organizes a large amount of pages, yet is compact and easily stored.

BRIEF DESCRIPTION OF THE DRAWINGS

Throughout the figures of the drawings, where the same part appears in one or more than one figure of the drawings, the same number is applied thereto.

DESCRIPTION OF THE PREFERRED EMBODIMENTS

Figure 1:
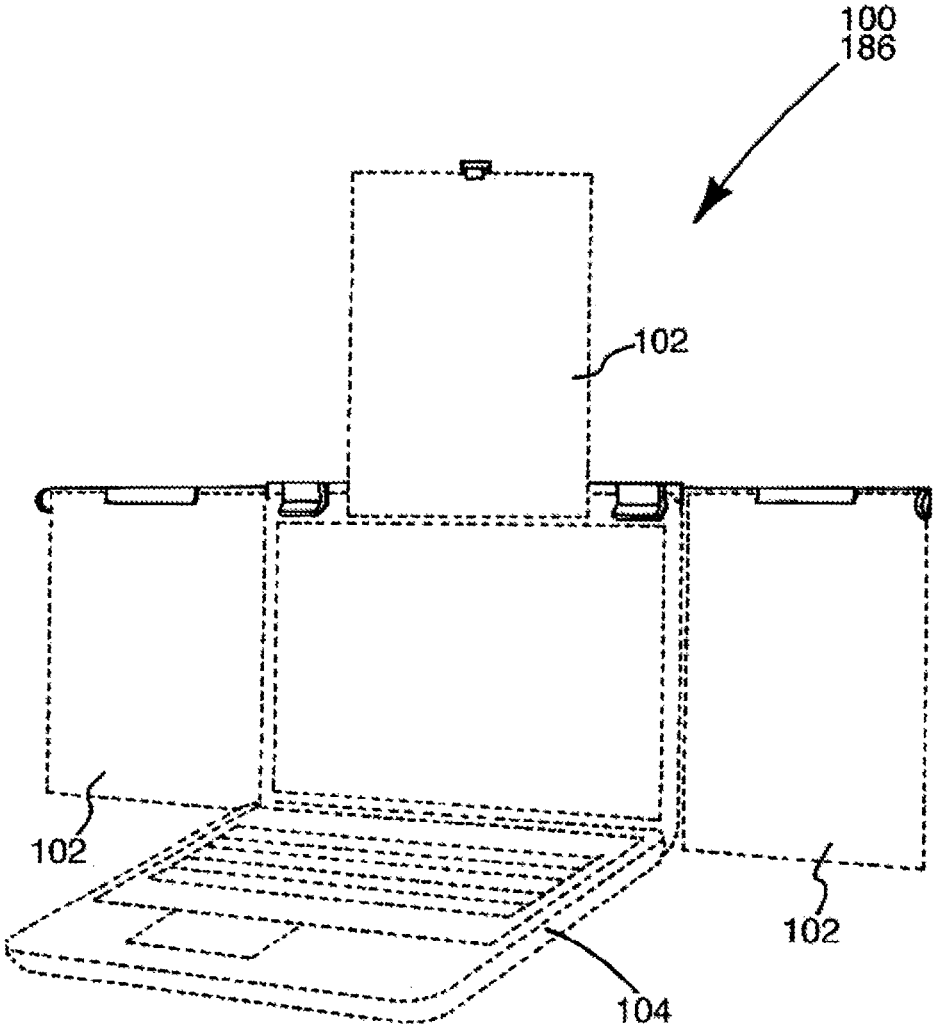
FIG. 1 depicts a front perspective view of document holder 100 in full extension 186 holding three documents 102, which are depicted in phantom, mounted on computer 104 which is depicted in phantom.

Reference will now be made in detail to several embodiments of the invention that are illustrated in accompanying drawings. Whenever possible, the same or similar reference numerals are used in the drawings and the description to refer to the same or like parts or steps. The drawings are in simplified form and are not to precise scale. For purposes of convenience and clarity only, directional terms such as top, bottom, left, right, up, over, above, below, beneath, rear, and front, may be used with respect to the drawings. These and similar to directional terms are not to be construed to limit the scope of the invention in any manner. The words attach, connect, couple, and similar terms with their inflectional morphemes do not necessarily denote direct or intermediate connections, but may also include connections through mediate elements or devices.

A document holder is mounted to either a desktop or laptop computer. The document holder allows a user to read and organize multiple documents and places the documents in the user's visual range while using the computer. The document holder may be fully extended and has three arms. Each of the three arms is capable of holding multiple documents in a secure and flat plane position. The document holder can hold up to 30 or more documents at a single time. When the document holder is not in use it folds compactly into a stored position and does not interfere with the use of the computer. The document holder opens and closes in a telescopic or pivotal fashion.

A significant advantage of the document holder is that it can be attached to the computer without the need for adhesives or glue. This is very beneficial because the document holder can be attached to or removed from the computer with ease. The attachment and removal process does not harm the computer in any fashion which provides great advantages compared to attachment using adhesives or glue.

The terms document and documents are used interchangeably throughout this application. Each arm of the document holder may hold a single document or multiple documents depending on the user preference.

Now adding FIG. 1 to the consideration the structure and function of document holder 100 can be clearly seen. In this view, document holder 100 is holding three documents 102 on computer 104. Document holder 100 is in full extension 186 so that three documents 102 can be viewed at once. However, document holder 100 can hold more than three documents 102. Document holder 100 can hold 100 or more documents at a single time.

Figure 2:
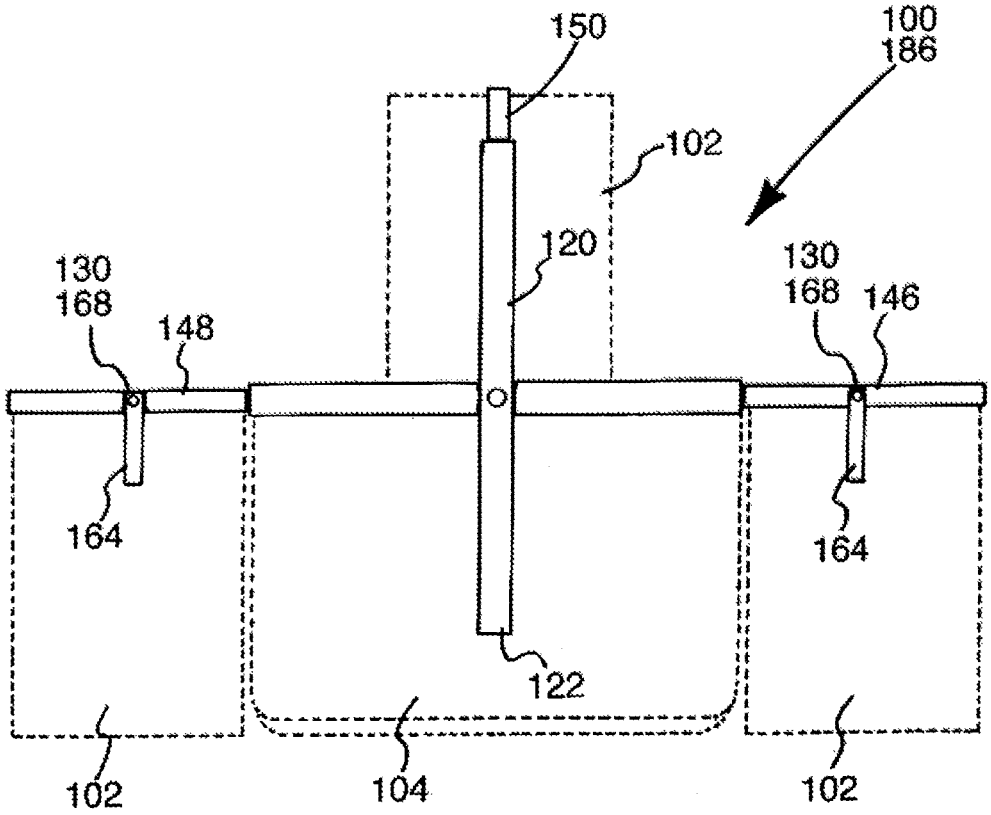
FIG. 2 depicts a rear view of document holder 100 showing sheet support 164 and center channel 120 with documents 102 and computer 104 shown in phantom.

Now adding FIG. 2 to the consideration, further features of document holder 100 can be clearly seen. In this view, document holder 100 is in full extension 186. Right arm 148 is connected to computer 104 and holding document 102. Sheet support 164 supports one or multiple documents 102 and aids in keeping documents 102 in a flat plane and stable position. Left arm 146 functions similarly to right arm 148. Left arm 146 is connected to computer 104 and is holding documents 102 in place with the help of sheet support 164. Center arm 150 functions similarly to right arm 148 and left arm 146 and is connected to computer 104. Center arm 150 is holding documents 102 in place.

Center arm 150 extends out from center channel 120 and holds document 102 in a flat plane and stable position. Center channel 120 also adds support to center arm 150. Center channel 120 contains center stabilizer end 122 which supports the entire document holder 100 as it rests against the back of computer 104.

Figure 3:
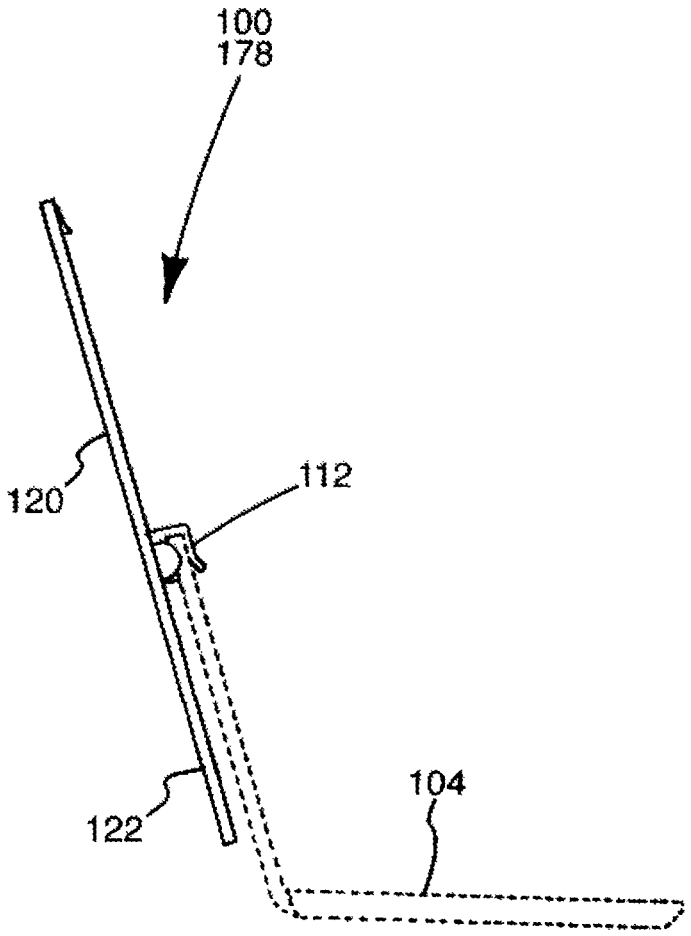
FIG. 3 depicts a profile view 178 of document holder 100 which shows center channel 120 and center stabilizer end 122 which work in conjunction with mount clamp 112. Computer 104 is depicted in phantom.

Now adding FIG. 3 to the consideration, the structure, function, security, and stability of document holder 100 can be more clearly seen. In this figure, profile view 178 of document holder 100 is seen. Center channel 120 and center stabilizer end 122 rest against the back of computer 104. Center channel 120 and center stabilizer end 122 work in conjunction with mount clamp 112 to keep the document holder 100 secure and stable. Mount clamp 112 rests against the front of computer 104.

Figure 4:
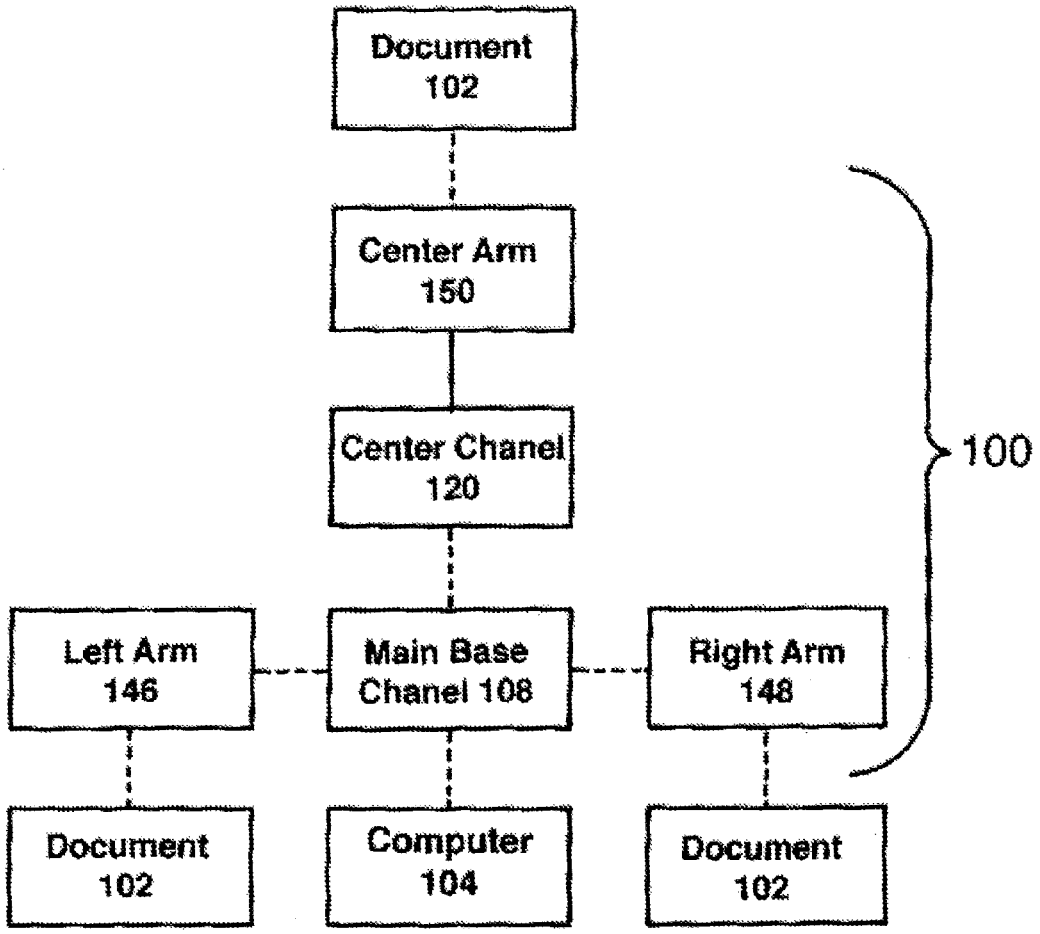
FIG. 4 depicts a block diagram of document holder 100 of this invention.

Now adding FIG. 4 to the consideration, the structure and function of document holder 100 is further depicted. Document holder 100 rests against computer 104. Document holder 100 has left arm 146, right arm 148, and center arm 150 to hold documents 102 in a flat plane and stable position. Main base channel 108 rests against the back of computer 104. Center channel 120 rests against the back of computer 104 to hold center arm 150 in place and add support and stability.

Figure 5:
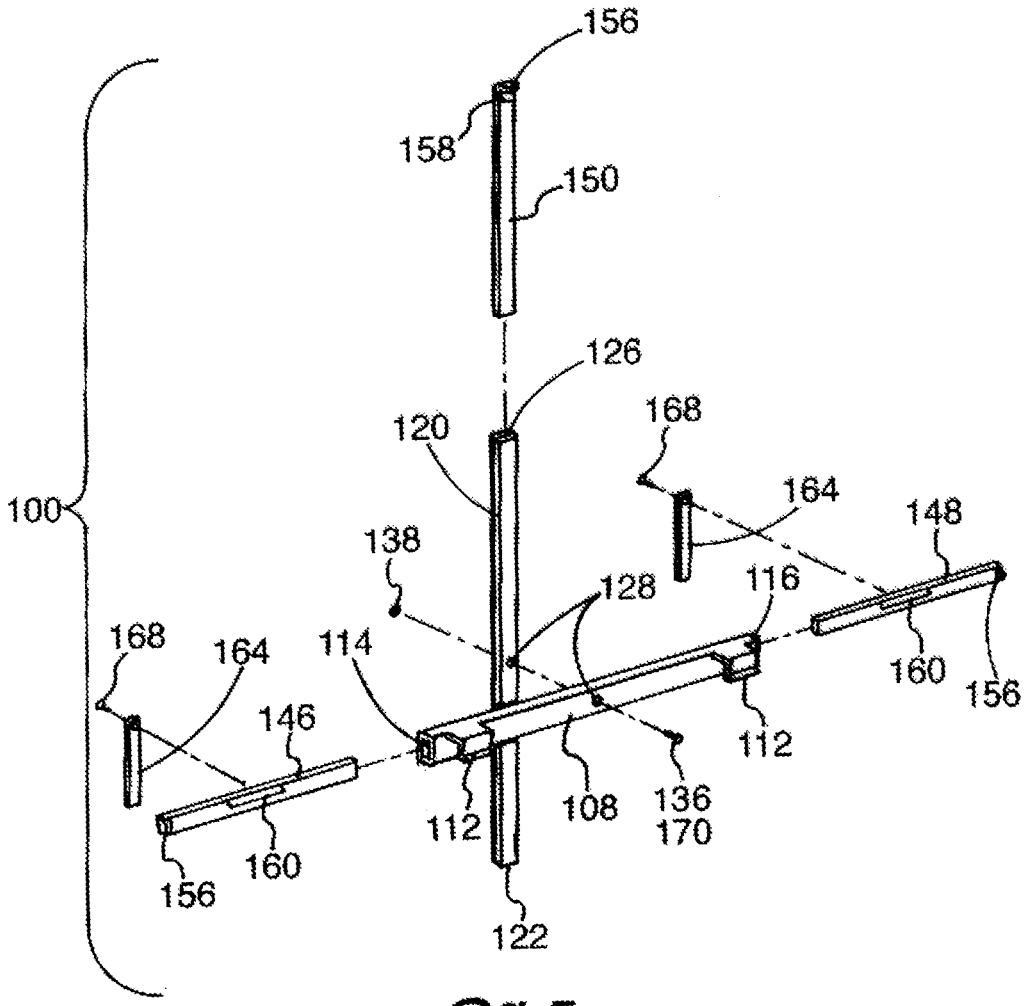
FIG. 5 depicts a front, perspective, exploded view of document holder 100.

Now adding FIG. 5 to the consideration, the structure of document holder 100 is more clearly depicted. Main base channel 108 rests against the back of computer 104. Left arm 146 and right arm 148 insert into main base channel 108 in a male to female relationship. Center channel 120 is connected to main base channel 108 through the cooperation of axle 170. Center arm 150 inserts into center channel 120 in a male to female relationship. Axle 170 may be any suitable structure which can provide the pivotal movement between main base channel 108 and center channel 120. In the preferred embodiment, axle 170 is the axle pin 136 which cooperates with the fulcrum aperture 128 and the axle pin cap 138. However, axle 170 can be a nut and bolt assembly, a rivet, or any other secure and pivotal fastening means.

Main base channel 108 and center channel 120 have fulcrum aperture 128 to accept axle pin 136 and the connection is secured by axle pin cap 138. Main base channel 108 has mount clamp 112 on each opposing end. Mount clamp 112 secures document holder 100 to computer 104.

Main base channel 108 has right arm receiving slot 116 which allows right arm 148 to attach to main base channel 108 in a telescopic male to female relationship. Right arm 148 has arm aperture 130 which cooperates with snap axle pin 168 to attach sheet support 164 to right arm 148. Arm aperture 130 is a blind aperture and does not extend through to the front of right arm 148. Snap axle pin 168 and arm aperture 130 are the preferred fastening means. However, any fastening means which create a secure and movable relationship between sheet support 164 and right arm 148 such as but not limited to, a screw, a snap fastener, a spline, or any other bonding fastener, are acceptable embodiments.

Figure 10:
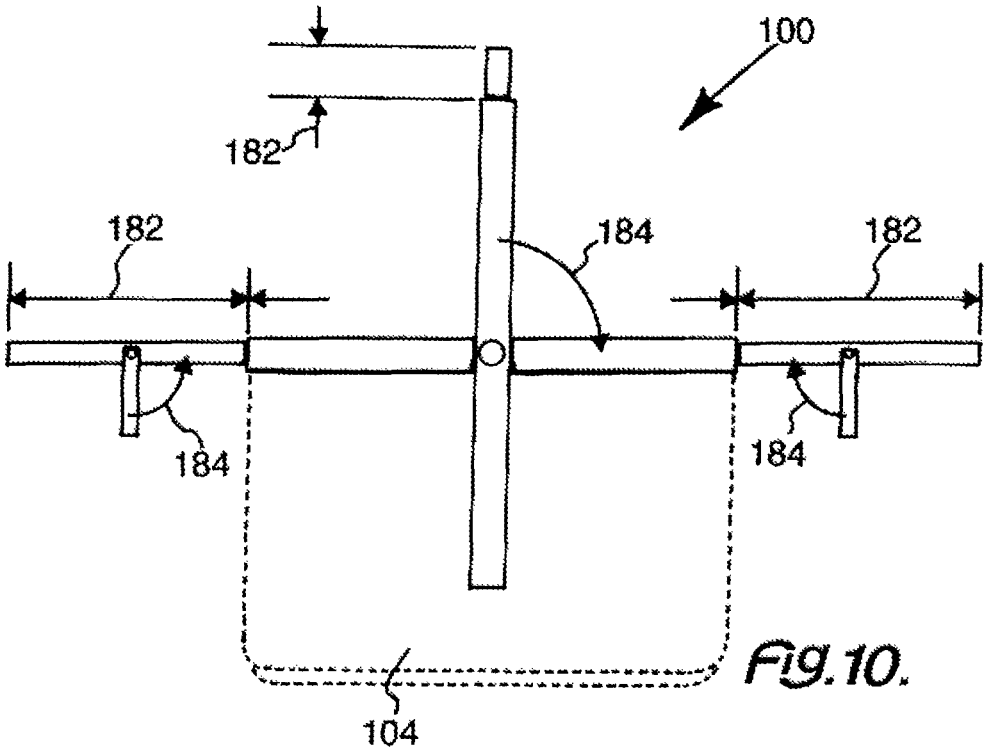
FIG. 10 depicts a rear view of document holder 100 featuring the extend and close swing travel 184 and open and close travel 182 with computer 104 depicted in phantom.

Document 102 inserts into grip tab 160 to further create a secure and stable flat plane position for document 102. Right arm 148 has pull tab 156 to provide a grip to aide in open and close travel 182 (FIG. 10).

Main base channel 108 also has left arm receiving slot 114 to allow left arm 146 to insert into main base channel 108 in a telescopic male to female relationship. Left arm 146 has an arm aperture 130 which cooperates with snap axle pin 168 to connect left arm 146 to sheet support 164. Left arm 146 has grip tab 160. Arm aperture 130 is a blind aperture and does not extend through to the front of left arm 146. Snap axle pin 168 and arm aperture 130 are the preferred fastening means. However, any fastening means which create a secure and movable relationship between sheet support 164 and left arm 146 such as but not limited to, a screw, a snap fastener, a spline, or any other bonding fastener, are acceptable embodiments.

Document 102 inserts into grip tab 160 to further create a secure and stable flat plane position for document 102. Left arm 146 has pull tab 156 to provide a grip to aid in open and close travel 182 (FIG. 10).

Center channel 120 accepts center arm 150 in a telescopic male to female relationship to allow it to rest against computer 104. Center channel 120 has center arm receiving slot 126 to aide in this telescopic male to female attachment. Center arm 150 has pull tab 156 to provide a grip to aide in open and close travel 182 (FIG. 10). Center arm 150 also has grip tab 158. Document 102 inserts into grip tab 158 to further create a secure and stable flat plane position for document 102. Center stabilizer end 122 rests against the back of computer 104. Center stabilizer end 122 allows center arm 150 to be securely attached to computer 104.

Figure 6:
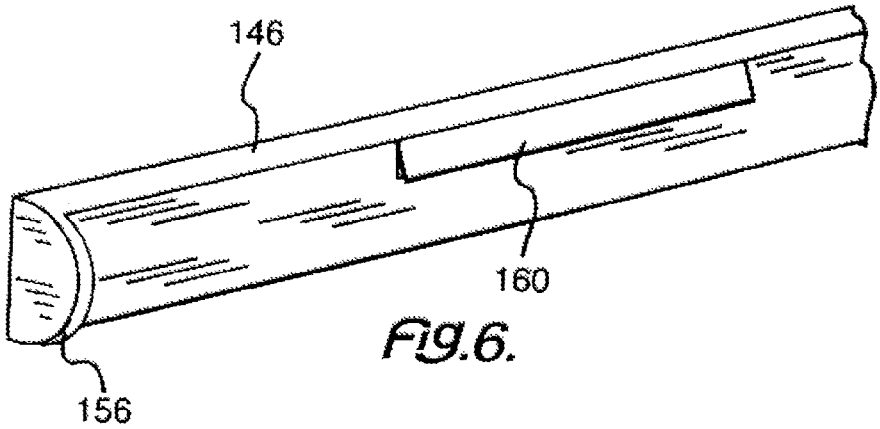
FIG. 6 depicts a front perspective view of left arm 146 featuring grip tab 160 and pull tab 156.
Figure 7:
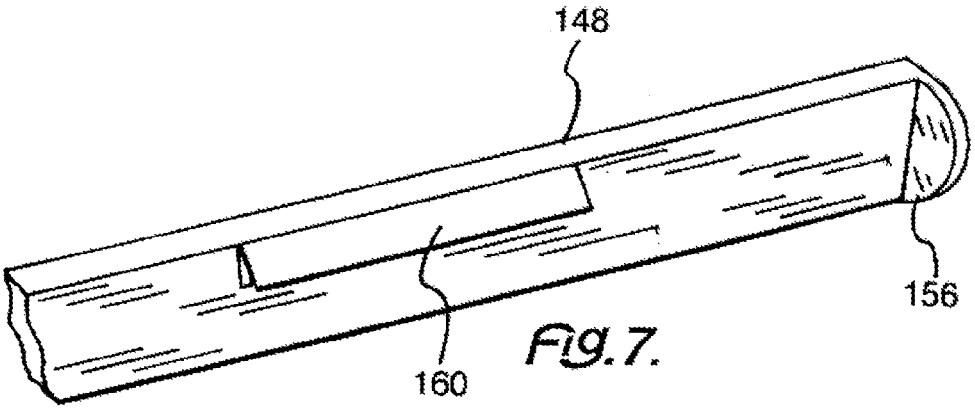
FIG. 7 depicts a front perspective view of right arm 148 featuring grip tab 160 and pull tab 156.
Figure 8:
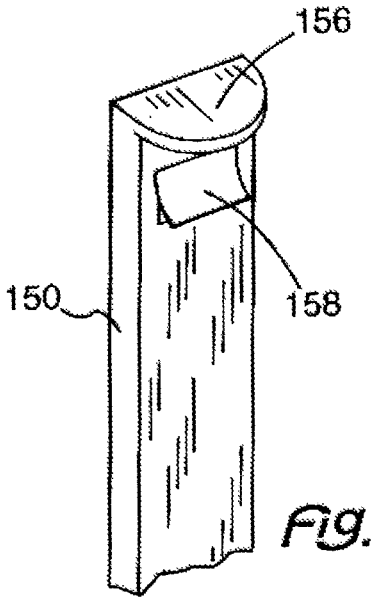
FIG. 8 depicts a front perspective view of center arm 150 featuring grip tab 158 and pull tab 156.

Now adding FIG. 6, FIG. 7, and FIG. 8 to the consideration, the structure and function of pull tab 156, grip tab 158, and grip tab 160 can be clearly seen. FIG. 6 depicts the pull tab 156 and grip tab 160 on left arm 146. FIG. 7 depicts the pull tab 156 and grip tab 160 on right arm 148. FIG. 8 depicts the pull tab 156 and grip tab 158 on center arm 150.

Grip tab 158 and grip tabs 160 are molded, welded, fastened, or use any other suitable securing method to arms 146, 148, and 150. Between grip tab 158 and grip tabs 160 and arms 146, 148, and 150 is a space to accept document 102. Grip tab 158 and grip tabs 160 have a natural spring action to allow it to be lifted outward to accept documents 102 and then snapped back into place to secure documents 102 in a secure and stable position. Grip tab 158 and grip tabs 160 have the resilience to snap back into position after they are lifted outward to accept documents 102.

Arms 146, 148, and 150 have pull tabs 156. Pull tabs 156 provide a grip to aid document holder 100 in open and close travel 182 (FIG. 10). Pull tabs 156 ease the open and close travel 182 of document holder 100.

Figure 9:
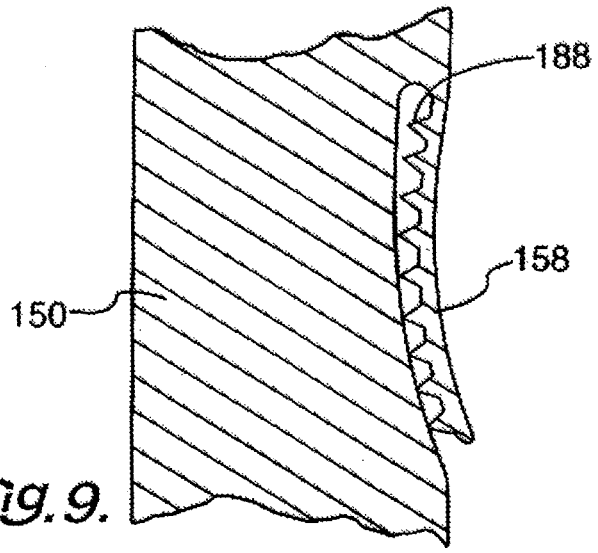
FIG. 9 depicts a cross section view of grip tab 158.

Now adding FIG. 9 to the consideration, the cross section view allows the structure and function of grip tab 158 to be clearly seen. The cross section view of grip tab 160 is substantially similar to grip tab 158.

Center arm 150 has at least one grip tab 158 to secure document 102 to document holder 100. Document 102 inserts between grip tab 158 and center arm 150. Document 102 slides into grip tab 158 which allows it to provide a space to accept document 102. Once document 102 is inserted, grip tab 158 has the natural resilient springing action to snap back into place against center arm 150 to secure document 102 in a stable flat plane. Furthermore, grip tab 158 has teeth 188 to further secure the attachment between document 102 and center arm 150. Teeth 188 push against document 102 which forces document 102 to be further pushed against center arm 150. Teeth 188 are the preferred embodiment but ridges or any other suitable securing mechanism can be utilized and are covered in this description.

Now adding FIG. 10 to the consideration, the open and close travel 182 can be clearly seen. Document holder 100 is attached to computer 104. FIG. 10 is a rear view of document holder 100. Right arm 148 has the capability of open and close travel 182. When document holder 100 is in use, right arm 148 is extended outward from main base channel 108 through open and close travel 182. When document holder 100 is not in use, right arm 148 is pushed into main base channel 108 and closed inward through open and close travel 182 which allows it to be compactly stored and not interfere with use. The open and close travel 182 for right arm 148 is horizontal in motion.

Left arm 146 has the capability of open and close travel 182. When document holder 100 is in use, left arm 146 is extended outward from main base channel 108 through open and close travel 182. When document holder 100 is not in use, left arm 146 is pushed and closed into main base channel 108 through open and close travel 182. The open and close travel 182 allows document holder 100 to be compactly stored and not interfere with the use of computer 104. The open and close travel 182 for left arm 146 is horizontal in motion.

Sheet supports 164 move inward and align with either left arm 146 or right arm 148 through extend and close swing travel 184. Sheet supports 164 move upward when not in use so they insert into main base channel 108 with left arm 146 and right arm 148. Thus, sheet supports 164 do not interfere with use of computer 104 when document holder 100 is not in use. Sheet supports 164 move downward when document holder 100 is in use to support document 102.

Center arm 150 has the capability of open and close travel 182. When document holder 100 is in use, center arm 150 is extended upward and out of center channel 120 through open and close travel 182. Center channel 120 is extended upward from main base channel 108. Center channel 120 is substantially perpendicular to main base channel 108 when in full extension 186. When document holder 100 is not in use, center arm 150 is pushed into center channel 120 and closed downward through open and close travel 182. Center channel 120 swings downward and aligns with main base channel 108 through extend and close swing travel 184. Center channel 120 is substantially parallel to main base channel 108 when aligned for stored position (See FIG. 11). Extend and close swing travel 184 allows document holder 100 to be compactly stored and not interfere with the use of computer 104 when document holder 100 is not in use. The open and close travel 182 for center arm 150 is vertical in motion.

Figure 11:
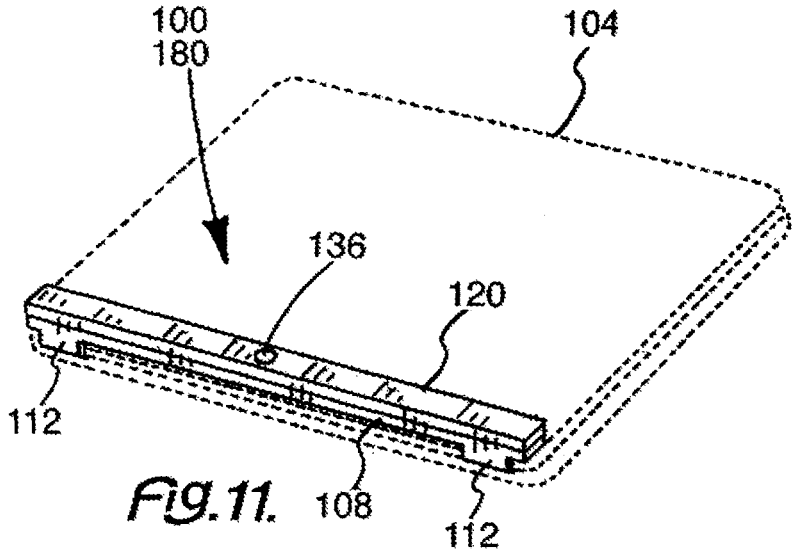
FIG. 11 depicts a rear perspective view of stored position 180 of document holder 100 of this invention with computer 104 depicted in phantom.

Now adding FIG. 11 to the consideration, the stored position 180 of document holder 100 can be clearly seen. When document holder 100 is not in use but computer 104 is in use, document holder 100 compactly folds together as not to interfere with the use of computer 104. Arms 146 and 148 use open and close travel 182 to push inward for stored position 180. Arms 146 and 148 use open and close travel 182 and move horizontally into main base channel 108. Center arm 150 uses open and close travel 182 to insert into center channel 120. Center channel 120 uses extend and close swing travel 184 to turn to a parallel position to main base channel 108. The cooperation of axle pin 136, fulcrum aperture 128, and axle pin cap 138 allows center channel 120 and center arm 150 to rotate 360 degrees on its axle pin cap 138, fulcrum aperture 128, and axle pin 136. Main base channel 108 always remains in a constant position. Mount clamps 112 are designed to cause the least interference with the use of computer 104 when document holder 100 is not in use.

Figure 12:
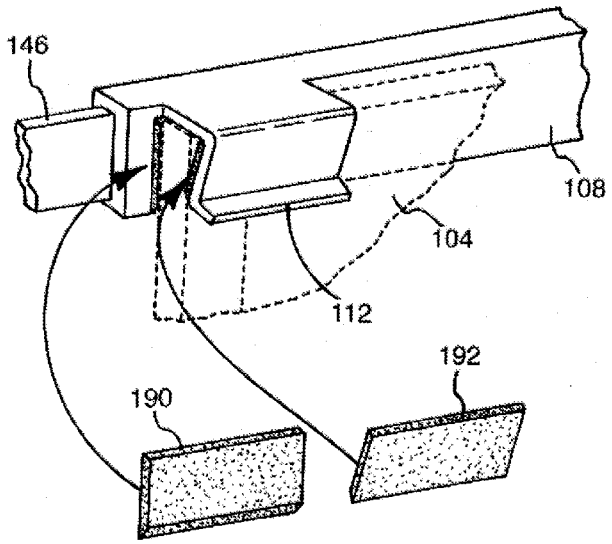
FIG. 12 depicts a front perspective view of mount clamp 112 attaching document holder 100 to computer 104 which is depicted in phantom.
Figure 13:
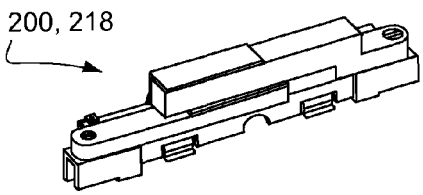
FIG. 13 depicts a front perspective view of document holder 200 in stored position 218.

Now adding FIG. 12 to the consideration, the structure of mount clamp 112 can be easily seen. Mount clamp 112 extends from main base channel 108 and extends over the top and down the front of computer 104. Mount clamp 112 is secured to computer 104 through tension. Mount clamp 112 has an outward angle at the end to allow easy removal of document holder 100 from computer 104.

Main base channel 108 has rear rubber pad 190 and mount clamp 112 has front rubber pad 192. Rubber pads 190 and 192 add a cushioning support such that document holder 100 does not damage computer 104 during the attachment and removal process. While the preferred material for pads 190 and 192 is rubber any suitable padding material such as plastic or foam is encompassed by this disclosure.

Now adding FIGS. 13 to 25 to the consideration, a second embodiment of the document holder can be clearly seen. Document holder 200 has main base channel 202. Left arm 204 and right arm 206 are connected to main base channel 202 through left sliding bracket 210 and right sliding bracket 212. Center arm 208 is connected to main base channel 202.

Main base channel 202 is attached to computer 104 through mount clamps 280. Mount clamps 280 create releasable tension to allow the main base channel 202 to be securely attached to computer 104 and yet allow it to be removed when desired. Mount clamps 280 are secured to computer 104 through tension. Mount clamps 280 may have an outward angle at the end to allow easy removal of document holder 200 from computer 104.

Main base channel 202 has camera aperture 250. Camera aperture 250 allows document holder 200 to remain in place on the computer 104 without interfering with the function of any camera equipment or hardware that may be a part of computer 104.

Center arm 208 has upper support 230 and lower support 232. Upper support 230 is pivotably connected to lower support 232 through the cooperation of upper support aperture 260 and lower support axle 246. Lower support 232 has lower support axle 246 and upper support 230 has upper support aperture 260.

Center arm 208 is pivotably connected to main base channel 202 through the cooperation of lower support aperture 262 and base axle 244. Lower support 232 has lower support aperture 262 and main base channel 202 has base axle 244.

Left arm 204 and right arm 206 are similar in structure and function with the only difference being that they are mirror images of each other. Left arm 204 and right arm 206 are attached to main base channel 202 through left sliding bracket 210 and right sliding bracket 212. Left sliding bracket 210 and right sliding bracket 212 are in a sliding relationship to main base channel 202. This movable and slidable relationship allows document holder 200 to accommodate varying sizes of computers 104.

Left arm 204 and right arm 206 are pivotably connected to left sliding bracket 210 and right sliding bracket 212. This pivotable connection is achieved through the cooperation of left axle 214 and right axle 216 on left sliding bracket 210 and right sliding bracket 212 and left aperture 252 and right aperture 254 on left arm 204 and right arm 206.

Figure 17:
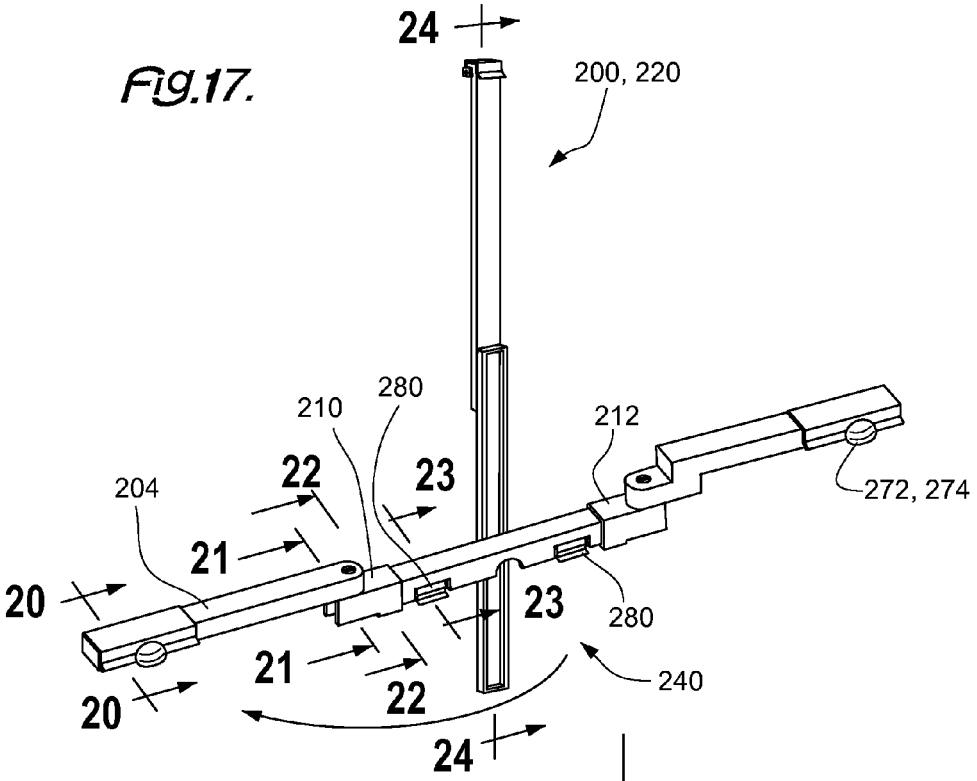
FIG. 17 depicts a front perspective view of document holder 200 in fully extended position 220 and wide position 240.

As depicted in FIG. 17, left arm 204 and right arm 206 are extended to wide position 240. Sliding brackets 210 and 212 are slid outward along main base channel 202 to accommodate for a larger computer 104. Stop tabs 282 on main base channel 202 and sliding brackets 210 and 212 prevent sliding brackets 210 and 212 to be extended too far outward and slide beyond the end of main base channel 202.

Figure 18:
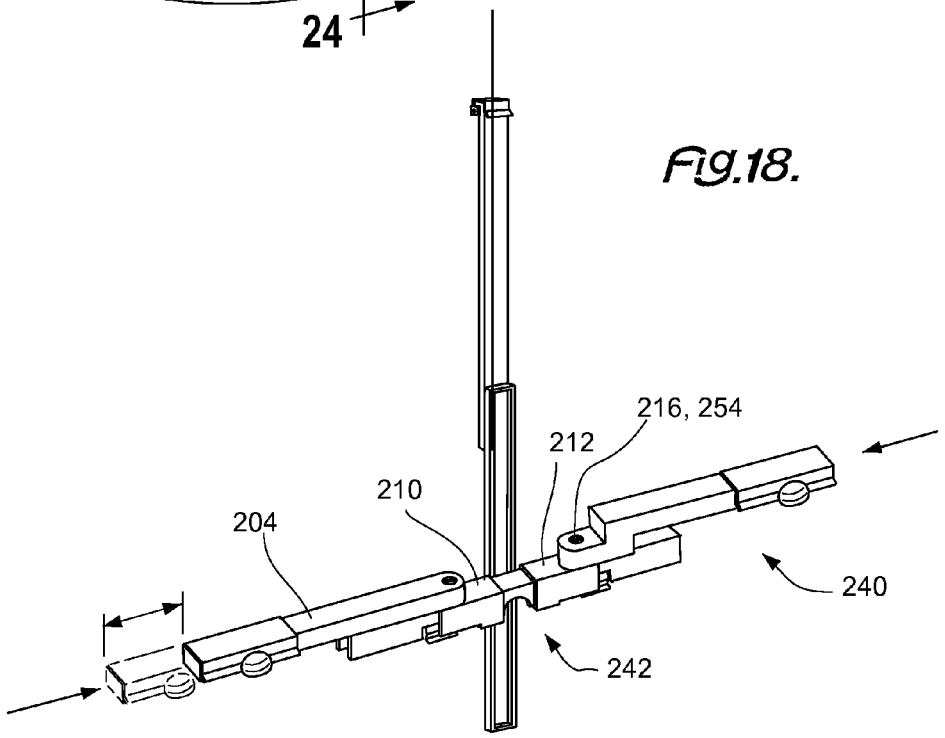
FIG. 18 depicts a front perspective view of document holder 200 in fully extended position 220 and narrow position 242.
Figure 19:
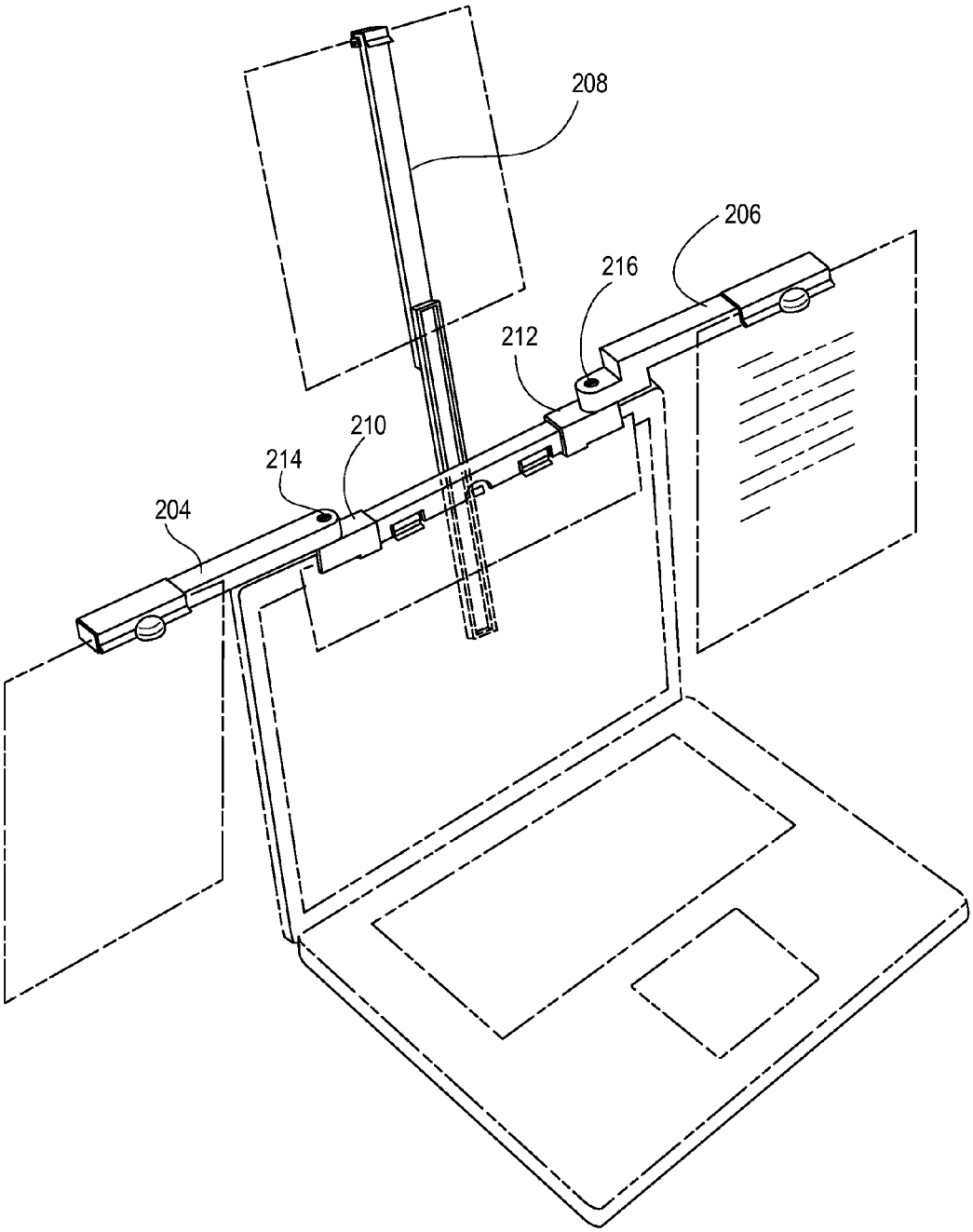
FIG. 19 depicts a front perspective view of document holder 200 in use on computer 104 and holding documents 102 with documents 102 and computer 104 depicted in phantom.
Figure 20:
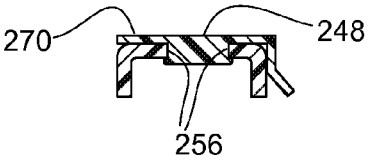
FIG. 20 depicts a cross section view, demarcated at 20 in FIG. 17, of grip bar or tab 270.
Figure 21:
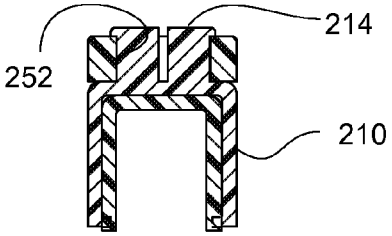
FIG. 21 depicts a cross section view, demarcated at 21 in FIG. 17, of left sliding bracket 210 and main base channel 202.
Figure 22:
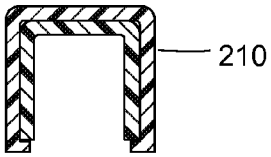
FIG. 22 depicts a cross section view, demarcated at 22 in FIG. 17, of left sliding bracket 210 and main base channel 202.
Figure 23:
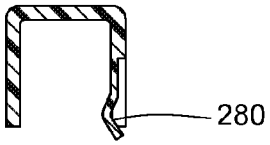
FIG. 23 depicts a cross section view, demarcated at 23 in FIG. 17, of main base channel 202 and mount clamp 280.
Figure 24:
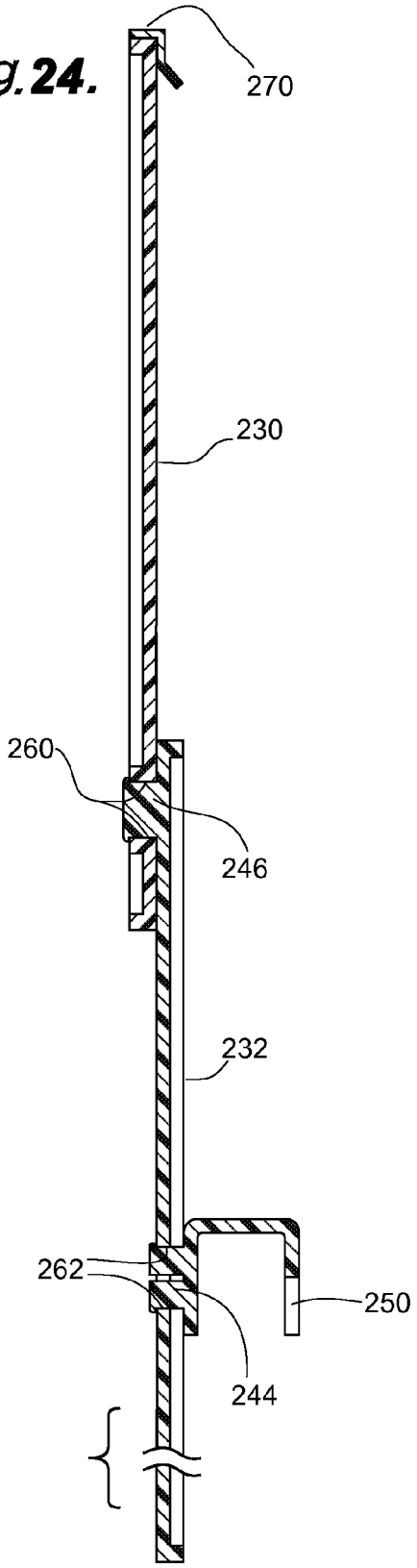
FIG. 24 depicts a cross section view, demarcated at 24 in FIG. 17, of center arm 208 and main base channel 202.
Figure 25:
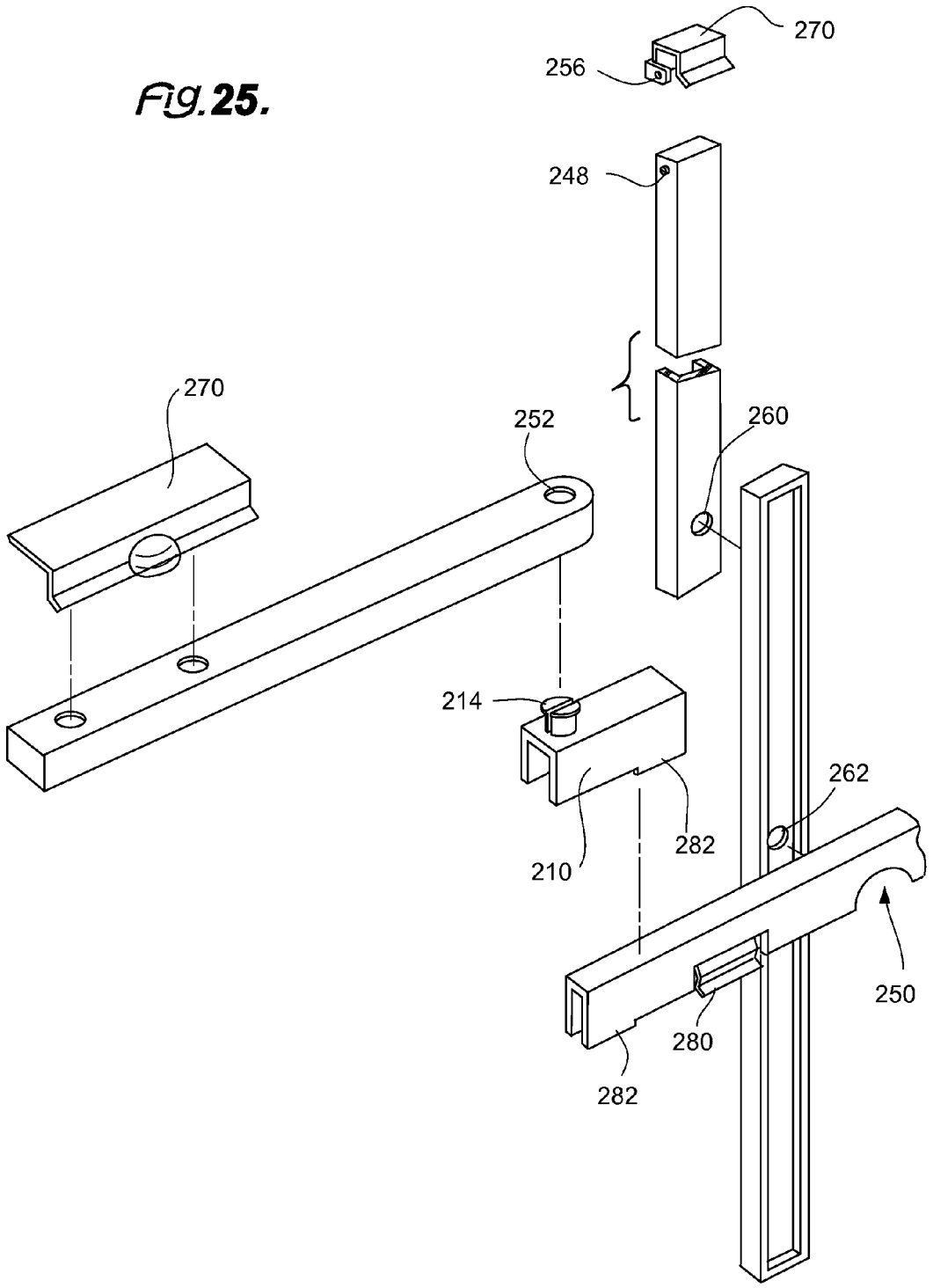
FIG. 25 depicts an exploded perspective view of main base channel 202, left arm 204 and center arm 208 of document holder 200.

As depicted in FIG. 18, left arm 204 and right arm 206 are compressed to narrow position 242. Sliding brackets 210 and 212 are slid inward along main base channel 202 to accommodate for a smaller computer 104.

Upper support 230, left arm 204 and right arm 206 each have a grip bar or tab 270. Each grip bar or tab 270 rests against upper support 230, left arm 204 and right arm 206 through tension. Between each grip bar or tab 270 and upper support 230, left arm 204 and right arm 206 is a space to accept document 102. Grip bar or tab 270 has a natural spring action to allow it to be lifted outward to accept documents 102 and then snapped back into place to secure documents 102 in a secure and stable position. Grip bar or tab 270 has the resilience to snap back into position after it is lifted outward to accept documents 102.

Tab 272 allows grip bar or tab 270 to be raised up and off of upper support 230, left arm 204 and right arm 206. Once tab 272 is released, the tension between grip bar or tab 270 and upper support 230, left arm 204 and right arm 206 secures the documents 102 in the desired position.

Tabs 272 may have ridges 274 to provide for easier gripping and control of tabs 272 while the grip bar or tab 270 is being raised or otherwise maneuvered. Ridges 274 may include, but are not limited to, structural features such as raised projections, semi-adhesive or friction adding materials such as rubber, or any other suitable material or structure that increases the ability to grip between the tabs 272 and a finger of a user for the purpose of lifting tabs 272 to insert documents 102.

Grip bar or tab 270 is connected to left arm 204, right arm 206 and upper support 230 through the cooperation with grip bar or tab apertures 256. Left arm 204, right arm 206 and upper support 230 each have grip bar or tab apertures 256. Grip bar or tab apertures 256 cooperate with grip bar or tab axles 248 on tabs 270 to secure grip bar or tab 270 to left arm 204, right arm 206 and upper support 230. While two grip bar or tab axles 248 and two grip bar or tab apertures 256 are depicted, any suitable number of axles 248 and apertures 256 may be used to create a secure and stable connection and are encompassed by this disclosure. Any suitable method can be used to secure grip bar or tab 270 to left arm 204, right arm 206 and upper support 230 including, but not limited to, molding, welding, fastening, or any other suitable securing method and such methods are encompassed by this disclosure.

Referring specifically to FIG. 13, FIG. 14, FIG. 15, FIG. 16, FIG. 17 and FIG. 18, the transition of document holder 200 from stored position 218 to fully extended position 220 can be clearly seen. This series of Figures is meant to be exemplary and is not depicted to limit the transition from stored position 218 to fully extended position 220 to any particular sequence of events. In document holder 200, main base channel 202 acts a channel by allowing for medial or lateral travel of left sliding bracket 210 and right sliding bracket 212 from stored position 218 to fully extended position 220. Stored position 218 allows document holder 200 to remain on computer 104 and not interfere with or obstruct the use of computer 104 when the document holder 200 is not is use.

Figure 14:
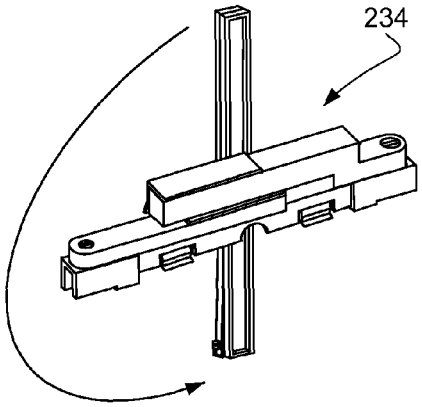
FIG. 14 depicts a front perspective view of document holder 200 with center arm 208 in partially unfolded position 234.
Figure 15:
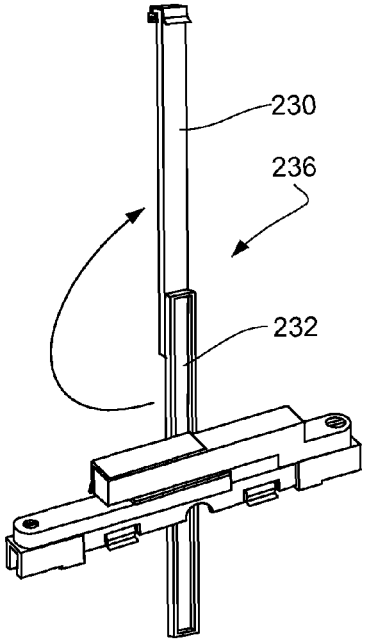
FIG. 15 depicts a front perspective view of document holder 200 with center arm 208 in fully unfolded position 236.
Figure 16:
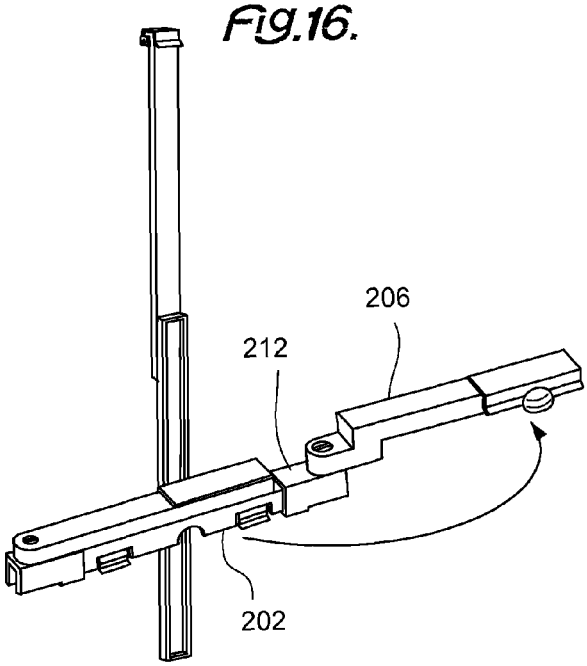
FIG. 16 depicts a front perspective view of document holder 200 with right arm 206 extended away from main base channel 202.

Lower support 232 pivots away from main base channel 202 and forms partially unfolded position 234 in respect to center arm 208 (See FIG. 14). Upper support 230 then pivots upward from lower support 232 to form fully unfolded position 236 in respect to center arm 208 (See FIG. 15). Right arm 206 pivots away from main base channel 202 (See FIG. 16). Left arm 204 pivots away from main base channel 202 (See FIG. 17 and FIG. 18).

This application—taken as a whole with the abstract, specification, claims, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this tool can become clear to a person having ordinary skill in this particular art. Such modifications are clearly covered by this disclosure.

What is claimed and sought to be protected by Letters Patent is:

1. A document holder which attaches to a computer and allows visual access to at least one document comprising:

a) the document holder being connectable to the computer;
b) the at least one document attaching to the document holder;
c) the document holder having a fully extended position and a stored position;
d) the document holder having at least one arm to hold the at least one document;
e) the at least one arm being a right arm, a left arm, and a center arm;
f) the left arm and the right arm being substantially similar;
g) the document holder having a main base channel;
h) the right arm and the left arm each having at least one grip bar or tab connected through an attaching means;
i) the at least one grip bar or tab aiding in keeping the at least one document in a stable position;
j) the right arm and the left arm being connected to the main base channel in a movable relationship;
k) the center arm being connected to the main base channel in a movable relationship;
l) the left arm being slidably attached to the main base channel through a left sliding bracket;
m) the right arm being slidably attached to the main base channel through a right sliding bracket;
n) the left arm having a left aperture and the right arm having a right aperture;
o) the left sliding bracket having a left axle and the right sliding bracket having a right axle;
p) the left arm being pivotably attached to the left sliding bracket through the cooperation between the left axle and the left aperture;
q) the right arm being pivotably attached to the right sliding bracket through the cooperation between the right axle and the right aperture;
r) the main base channel and the center arm attaching to each other in a pivotable relationship;
s) the center arm having an upper support and a lower support;
t) the lower support having a lower support aperture and the upper support having an upper support aperture;
u) the main base channel having a base axle which cooperates with the lower support aperture to pivotably attach the lower support to the main base channel;
v) the lower support having a lower support axle which cooperates with the upper support aperture to pivotably attach the lower support to the upper support; and
w) the main base channel having at least one mount clamp to removably attach the document holder to the computer.

2. The document holder of claim 1 further comprising:

a) the right sliding bracket being movable along a lateral axis of the main base channel to create a right wide position and a right narrow position;
b) the left sliding bracket being movable along the lateral axis of the main base channel to create a left wide position and a left narrow position;
c) the lower support being pivotably connected to the main base channel to allow for a partially unfolded position and the stored position;
d) the upper support being pivotably connected to the lower support to allow for a fully unfolded position and the stored position;
e) the at least one mount clamp being two mount clamps extending from oppositely disposed ends of the main base channel;
f) the main base channel attaching the document holder to the computer through compression exerted on the computer by the main base channel and the two mount clamps; and
g) the upper support having at least one grip bar or tab connected through an upper support grip bar or tab attaching means.

3. The document holder of claim 2 further comprising:

a) the main base channel extending over the top and down the front of the computer to attach the document holder to the computer;
b) the main base channel resting against the front of the computer;
c) the at least one grip bar or tab having at least one grip bar or tab axle;
d) the right arm having at least one grip bar or tab aperture which cooperates with the at least one grip bar or tab axle as the attaching means for the at least one grip bar or tab;
e) the left arm having at least one grip bar or tab aperture which cooperates with the at least one grip bar or tab axle as the attaching means for the at least one grip bar or tab;
f) the upper support having at least one grip bar or tab aperture which cooperates with the at least one grip bar or tab axle as the upper support grip bar or tab attaching means for the at least one grip bar or tab;
g) the at least one grip bar or tab having a space between it and the upper support, the left arm, or the right arm to accept the at least one document;
h) the at least one grip bar or tab having a resilience to return to position once the at least one document is positioned;
i) the main base channel having a camera aperture to allow a camera of the computer to function while the document holder is attached to the computer;
j) the two mount clamps having an outward angle at an end to aid in attaching and removing the document holder from the computer; and
k) the main base channel having at least two stop tabs on oppositely disposed ends to cooperate with at least one stop tab on each of the left sliding bracket and the right sliding bracket to limit the movement of the left sliding bracket and the right sliding bracket along the lateral axis of the main base channel.

4. A method of attaching at least one document to a computer comprising:

a) mounting a document holder to the computer;

b) attaching the at least one document to the document holder;

c) providing the document holder with at least one arm to hold the at least one document;

d) connecting the at least one arm to the computer through the document holder;

e) providing the at least one arm as being a right arm, a left arm, and a center arm;

f) making the left arm and the right arm substantially similar;

g) providing the document holder with a main base channel;

h) providing each the right arm and the left arm with at least one grip bar or tab which is attached through an attaching means;

i) connecting the right arm and the left arm to the main base channel in a movable relationship;

j) connecting the center arm to the main base channel in a movable relationship;

k) slidably attaching the left arm to the main base channel through a left sliding bracket;

l) slidably attaching the right arm to the main base channel through a right sliding bracket;

m) providing the left arm with a left aperture and the right arm with a right aperture;

n) providing the left sliding bracket with a left axle and the right sliding bracket with a right axle;

o) pivotably attaching the left arm to the left sliding bracket through the cooperation between the left axle and the left aperture;

p) pivotably attaching the right arm to the right sliding bracket through the cooperation between the right axle and the right aperture;

q) pivotably attaching the main base channel to the center arm;

r) providing the center arm with an upper support and lower support;

s) providing the lower support with a lower support aperture and the upper support with an upper support aperture;

t) providing the main base channel with a base axle which cooperates with the lower support aperture to pivotably attach the lower support to the main base channel;

u) providing the lower support with a lower support axle which cooperates with the upper support aperture to pivotably attach the lower support to the upper support; and v) providing the main base channel with at least one mount clamp to removably attach the document holder to the computer.

5. The method of claim 4 further comprising:

a) providing the right sliding bracket as being movable along a lateral axis of the main base channel to create a right wide position and a right narrow position;

b) providing the left sliding bracket as being movable along the lateral axis of the main base channel to create a left wide position and left narrow position;

c) pivotably connecting the lower support to the main base channel to allow for a partially unfolded position and the stored position;

d) pivotably connecting the upper support to the lower support to allow for a fully unfolded position and the stored position;

e) providing the at least one mount clamp as being two mount clamps extending from oppositely disposed ends of the main base channel;

f) attaching the document holder to the computer using compression exerted on the computer by the main base channel and the two mount clamps;

g) providing the upper support with at least one grip bar or tab connected through an upper support grip bar or tab attaching means; and h) providing the at least one grip bar or tab on the left arm, the right arm, and the upper support as being capable of aiding in keeping the at least one document in a stable position.

6. The method of claim 5 further comprising:

a) extending the main base channel over the top and down the front of the computer to attach the document holder to the computer;

b) resting the main base channel against the front of the computer;

c) providing the at least one grip bar or tab with at least one grip bar or tab axle;

d) providing the right arm with at least one grip bar or tab aperture which cooperates with the at least one grip bar or tab axle as the attaching means for the at least one grip bar or tab;

e) providing the left arm with at least one grip bar or tab aperture which cooperates with the at least one grip bar or tab axle as the attaching means for the at least one grip bar or tab;

f) providing the upper support with at least one grip bar or tab aperture which cooperates with the at least one grip bar or tab axle as the upper support grip bar or tab attaching means for the at least one grip bar or tab;

g) providing the at least one grip bar or tab with a space between it and the upper support, the left arm, or the right arm to accept the at least one document;

h) providing the at least one grip bar or tab with a resilience to return to position once the at least one document is positioned;

i) providing the main base channel with a camera aperture to allow a camera of the computer to function while the document holder is attached to the computer;

j) providing the at least two mount clamps with an outward angle at an end to aid in attaching and removing the document holder from the computer; and k) providing the main base channel with at least two stop tabs on oppositely disposed ends to cooperate with at least one stop tab on each of the left sliding bracket and the right sliding bracket to limit the movement of the left sliding bracket and the right sliding bracket along the latera axis of the main base channel.

7. On a computer suitable for use as a word processor, the improvement comprising:

a) a document holder being mountable on the computer;

b) the document holder being adapted to support at least one document;

c) the document holder assisting in providing visual access to the at least one document;

d) the document holder having a fully extended position and a stored position;

e) the document holder having at least one arm to hold the at least one document;

f) the at least one arm being connected to the computer through the document holder;

g) the at least one arm being a right arm, a left arm, and a center arm;
h) the left arm and the right arm being substantially similar;
i) the document holder having a main base channel;
j) the right arm and the left arm each having at least one grip bar or tab connected through an attaching means;
k) the at least one grip bar or tab aiding in keeping the at least one document in a stable position;
l) the right arm and the left arm being connected to the main base channel in a movable relationship;
m) the center arm being connected to the main base channel in a movable relationship;
n) the left arm being slidably attached to the main base channel through a left sliding bracket;
o) the right arm being slidably attached to the main base channel through a right sliding bracket;
p) the left arm having a left aperture and the right arm having a right aperture;
q) the left sliding bracket having a left axle and the right sliding bracket having a right axle;
r) the left arm being pivotably attached to the left sliding bracket through the cooperation between the left axle and the left aperture;
s) the right arm being pivotably attached to the right sliding bracket through the cooperation between the right axle and the right aperture;
t) the main base channel and the center arm attaching to each other in a pivotable relationship;
u) the center arm having an upper support and a lower support;
v) the lower support having a lower support aperture and the upper support having an upper support aperture;
w) the main base channel having a base axle which cooperates with the lower support aperture to pivotably attach the lower support to the main base channel;
x) the lower support having a lower support axle which cooperates with the upper support aperture to pivotably attach the lower support to the upper support; and
y) the main base channel having at least one mount clamp to removably attach the document holder to the computer.

8. The improvement of claim 7, further comprising:
a) the right sliding bracket being movable along a lateral axis of the main base channel to create a right wide position and a right narrow position;
b) the left sliding bracket being movable along the lateral axis of the main base channel to create a left wide position and a left, narrow position;
c) the lower support being pivotably connected to the main base channel to allow for a partially unfolded position and the stored position;
d) the upper support being pivotably connected to the lower support to allow for a fully unfolded position and the stored position;
e) the at least one mount clamp being two mount clamps extending from oppositely disposed ends of the main base channel;
f) the main base channel attaching the document holder to the computer through compression exerted on the computer by the main base channel and the two mount clamps; and
g) the upper support, having at least one grip bar or tab connected through an upper support grip bar or tab attaching means.

9. The improvement of claim 8 further comprising:
a) the main base channel extending over the top and down the front of the computer to attach the document holder to the computer;
b) the main base channel resting against the front of the computer;
c) the at least one grip bar or tab having at least one grip bar or tab axle;
d) the right arm having at least one grip bar or tab aperture which cooperates with the at least one grip bar or tab axle as the attaching means for the at least one grip bar or tab;
e) the left arm having at least one grip bar or tab aperture which cooperates with the at least one grip bar or tab axle as the attaching means for the at least one grip bar or tab;
f) the upper support having at least one grip bar or tab aperture which cooperates with the at least one grip bar or tab axle as the upper support grip bar or tab attaching means for the at least one grip bar or tab;
g) the at least one grip bar or tab having a space between it and the upper support, the left arm, or the right arm to accept the at least one document;
h) the at least one grip bar or tab having a resilience to return to position once the at least one document Is positioned;
i) the main base channel having a camera aperture to allow a camera of the computer to function while the document holder is attached to the computer;
j) the at least two mount clamps having an outward angle at an end to aid in attaching and removing the document holder from the computer; and
k) the main base channel having at least two stop tabs on oppositely disposed ends to cooperate with at least one stop tab on each of the left sliding bracket and the right sliding bracket to limit the movement of the left sliding bracket and the right sliding bracket along the lateral axis of the main base channel.

* * * * *